United States Patent [19]

Cleland

[11] 4,406,783

[45] Sep. 27, 1983

[54] APPARATUS FOR SEPARATING ORE

[76] Inventor: Keith B. Cleland, 4460 Park Newport, Newport Beach, Calif. 92660

[21] Appl. No.: 323,140

[22] Filed: Nov. 19, 1981

[51] Int. Cl.[3] ..... B03B 5/74

[52] U.S. Cl. ..... 209/444; 209/452; 209/506

[58] Field of Search ..... 209/444, 452, 506, 260, 209/434, 436, 445, 451

[56] References Cited

U.S. PATENT DOCUMENTS

| | | | |
|---|---|---|---|
| 658,947 | 10/1900 | Goyne et al. . | |
| 987,866 | 3/1911 | Earle | 209/452 |
| 1,698,442 | 1/1929 | Lockett | 209/452 |
| 1,853,249 | 4/1932 | Ainlay . | |
| 1,986,778 | 1/1935 | Hinkley | 209/452 |
| 2,044,775 | 6/1936 | Dreifus | 209/452 |
| 2,064,554 | 12/1936 | Mahoney et al. | 209/452 |
| 2,269,538 | 1/1942 | Stephan | 209/441 |
| 2,298,016 | 10/1942 | Lineoln | 209/452 |
| 2,375,499 | 5/1945 | Shigley | 209/452 |
| 4,008,152 | 2/1977 | Kleven | 209/444 |
| 4,110,206 | 8/1978 | Kleven | 209/43 |
| 4,267,036 | 5/1981 | Kleven | 209/444 |

FOREIGN PATENT DOCUMENTS

| | | | |
|---|---|---|---|
| 846154 | 8/1960 | United Kingdom | 209/451 |

OTHER PUBLICATIONS

Exhibits A and B—2 p. Flyer Entitled "Simple, Portable, Affordable, Automatic Panning".

Exhibit C: 1 p. Flyer Entitled "Goldhound", 4078 Lincoln Blvd., Marina Del Rey, CA 90291, Apr. 1980.

*Primary Examiner*—Tim R. Miles

*Attorney, Agent, or Firm*—William W. Haefliger

[57] ABSTRACT

This invention provides an ore separating device of the rotating wheel type that includes a container, which may be of fiberglass, having a concave portion and an annular flange at its periphery with a pad having ridges on its outer surface complementarily overlying the concave portion and removably secured by fasteners. An annular rim complementarily overlies the peripheral portion of the container and is removably held therein by forwardly inclined vanes which agitate the ore during rotation of the container.

17 Claims, 6 Drawing Figures

APPARATUS FOR SEPARATING ORE

BACKGROUND OF THE INVENTION

This invention relates to improvements to ore separators of the type disclosed in U.S. Pat. No. 1,986,778 to Hinkley. In that patent, the bottom of the rotating bowl is made of a single unitized spiraled flat pad or liner. The present invention concerns a removable and replaceable liner for both bottom and sides of the rotating bowl. The liner is characterized by a two-part inner shell, one of which is for the rim of the concentration bowl and the other of which is for the bottom of that bowl. The liner is adapted for removable fastener attachment to that bowl, as will be seen.

BRIEF DESCRIPTION OF THE PREFERRED EMBODIMENT

The present invention provides an ore separator overcoming the problems of the prior art, enhancing the efficiency of ore separation and permitting rapid and economical servicing.

A separator includes a main unit defining a shallow container with a concave dished portion having an opening at its center for discharging dense materials as the container is rotated. An annular flange forms a periphery for the container over the outer edge of which are discharged the lighter, less dense particles. A pad defines the spirally arranged ridges on one side and complementarily overlies the concave portion of the container on its other side so as to provide a liner for the container. This pad is removably secured to the container by means of fasteners, rather than being bonded or otherwise permanently attached. The fasteners include nuts buried within the pad, facing outwardly and aligned with openings through the wall of the container to permit screws to enter and secure the pad in place.

Around the periphery of the device, at the annular flanged portion, is a rim inserted into the unit with its inner edge engaging the outer edge of the pad. Vanes or mixing and classifying bars project from the rim. The outer edges of the vanes are inclined forwardly in the direction of rotation so that these elements act as mixing and classifying devices to enhance the efficiency of the separator. They agitate the ore, mixing it so that heavier particles sink to the bottom for being moved along the grooves defined by the pad to the discharge openings. These bars also move the material at the bottom of the bowl up the face of the wheel to facilitate the separation of the heavier particles from the gangue. They produce a pumping action and a sweeping action that cause the kind of movement of the slurry within the separator to make the ore separation more effective and efficient.

DETAILED DESCRIPTION

Figure 1:
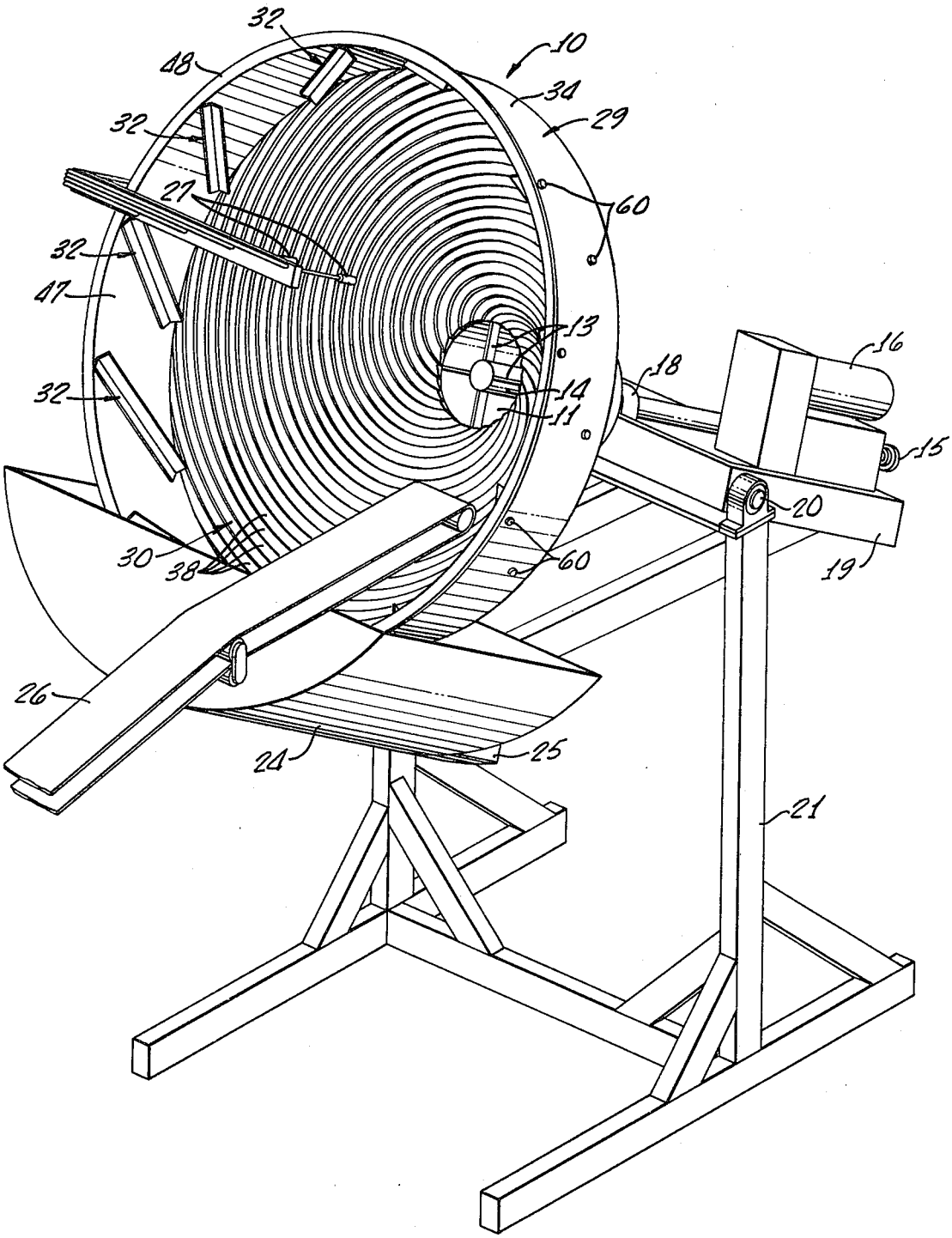
FIG. 1 is a perspective view of the ore separator of this invention.

The ore separator includes a shallow rotatable bowl or wheel 10 having an opening 11 at its center where the concentrated values of the ore are removed. A short reinforced cylindrical hub 12 projects axially away from the bowl 10 at the opening 11 and is connected by a spider 13 to a shaft 14. The latter element, through gears 15 and a source of power 16, is rotated in a clockwise direction as the device is seen in FIG. 1. This also rotates the bowl 10 in a clockwise direction.

Figure 2:
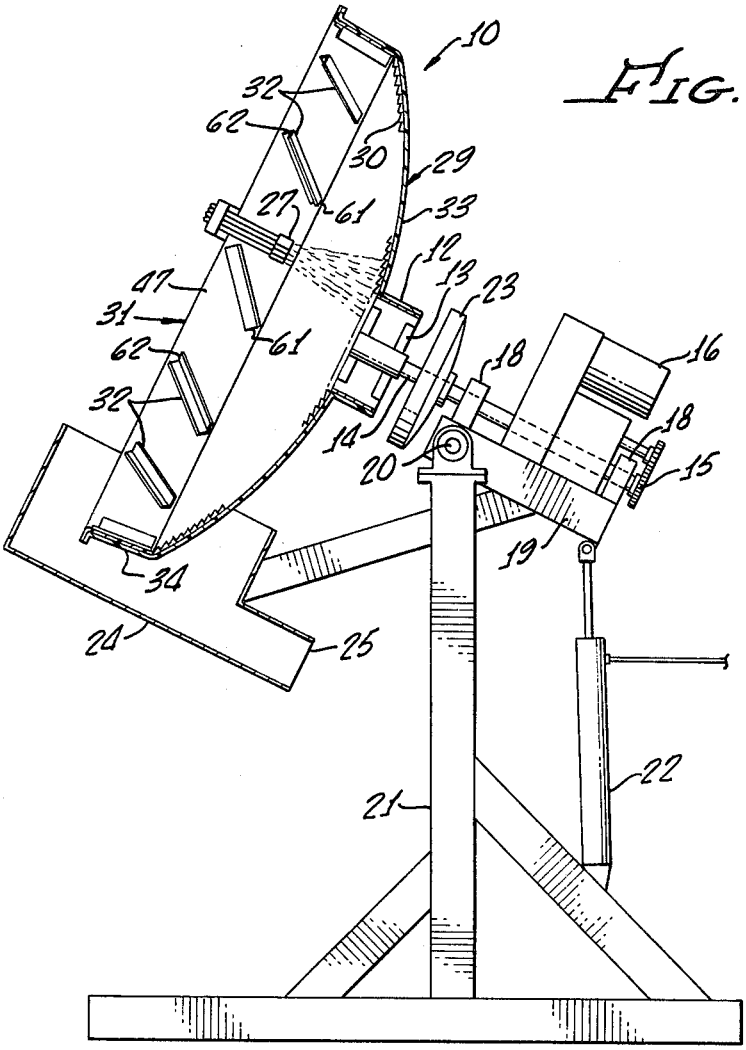
FIG. 2 is a side elevational view of the separator, partially in section.

The shaft 14 is supported in bearings 18 mounted on a table 19 which is pivotally connected through journals 20 to a standard 21. The table 19, on the side of the journals 20 opposite from the bowl 10, is engaged by a power cylinder 22 which normally holds the axis of the bowl at an acute angle to the horizontal, as seen in FIGS. 1 and 2. This enables the separating action to occur and the concentrated ore to be collected in a shallow receptacle 23 carried by the shaft 14 behind the hub 12. The gangue flows over the rim of the bowl 10 at its lower portion into a trough 24 from where it is discharged through an opening 25 for disposal. Ore to be concentrated is introduced into the bowl 10 by a conveyor belt 26. Water nozzles 27 project over the bowl to lubricate the ore.

As best seen in FIG. 2, the bowl 10 is made up of four basic components, that is, an outer shell 29, a pad 30, a rim 31 and mixing vanes or bars 32.

The shell 29 incorporates the hub 12 and defines the overall shape of the bowl 10. This includes a curved dished portion 33 that extends outwardly from the hub such that the bowl 10 provides a shallow container, concave interiorly. A wide peripheral flange 34 projects at an obtuse angle from the dished part 33 and in the embodiment illustrated flares outwardly slightly from the axis of the bowl so that it is frustoconical. An annular lip 35 extends radially outwardly from the outer edge of the peripheral flange 34.

The shell 29 advantageously is made out of fiberglass which enables it to be made economically in large diameters seven feet and more. Also, fiberglass construction causes the shell 29 to be lightweight and durable.

Figure 4:
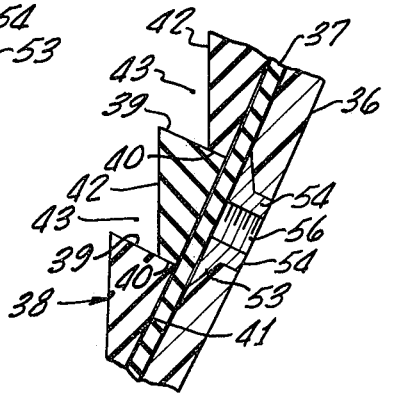
FIG. 4 is an enlarged fragmentary transverse sectional view of the pad that lines the bowl, illustrating the nuts within the pad for forming the removable attachment.

The pad 30, seen in detail in FIG. 4, is an assembly given the same curvature as that of the dished part 33 of the shell 29. Facing the shell 29 is a base sheet 36 of uniform thickness, preferably of fiberglass. A second sheet 37 of rubber overlies the concave side of the sheet 36. The sheet 37 is thinner than the sheet 36. On the sheet 37, arranged in a spiral fashion, are strips 38 which are trapezoidal in cross section and normally made of rubber. Each strip defines a relatively wide edge 39 which is perpendicular to the sheet 37 and parallel to a relatively narrow opposite edge 40. The bottom surface 41 of each strip is perpendicular to the edges 39 and 40 and is adjacent the pad 37. The other wall 42 inclines from the edge 39 to the edge 40. As a result, when the strips 38 are positioned on the sheet 37 they define grooves 43 extending spirally between a central opening 44 through the pad 30 and its periphery 45. The opening 44 has the same diameter as the opening 11 so that when the pad is in the shell 29 it overlies the entire surface of the concave portion 33. The grooves 43 extend from the outer edge of the portion 33 to the discharge opening 11.

The rim 31 may be constructed of fiberglass and is made complementary to the peripheral flange 34 and lip 35 of the shell 29. Thus, the rim 31 includes a frustoconical sectin 47 that is dimensioned to nest within and overlie the peripheral flange 34 of the shell 29. A radial lip 48 similarly can fit over the lip 35 of the shell 29.

The mixing bars 32 are steel or rubber angles, thus being L-shaped in cross section and having two straight equal legs 49 and 50. The leg 49 forms the base of the mixing bar that rests on the rim 31 and is provided with two parallel threaded studs 51 projecting perpendicularly outwardly from it. The other leg 50 is perpendicular to the rim 31 and defines a vane of uniform width.

The central part of the pad 30 is held to the bowl shell 29 by means of bolts 53 and nuts 54. The latter elements are of flush head configuration, extending through the base sheet 36 with their heads 55 countersunk into the inner wall of the base sheet. As a result, the heads 55 of the nuts do not interfere with the adjacent sheet 37 and the threaded openings 56 of the nuts face radially outwardly of the pad. The base sheet 36, being made of fiberglass, has adequate strength to hold the nuts 54, which are bonded in place, and is better suited for this purpose than if made of rubber like the remainder of the pad. When the pad 30 is placed within the dished central portion 33 of the shell 29, the nuts 54 are positioned in registry with openings 57 through the wall of the shell. This provides access to the threaded openings 55 of the nuts so that the shanks of the bolts 53 can enter the nuts and hold the pad to the shell. With nuts carried by the pad 30, instead of projecting elements such as threaded stud, the pad is easily positioned in the shell 29 and aligned properly.

The studs 51 of the mixing vanes 32 are used to hold the vanes to the peripheral flange 34 of the shell 29 so that the vanes also hold the rim 31 in its position. Openings 58 extend through the wall of the peripheral flange 34 of the shell 29, as do openings 59 through the frustoconical portion 47 of the rim 31. In assembling the bowl, with the pad 30 in place within the shell 29, the rim 31 is fitted into the peripheral flange 34 and its openings 59 are aligned with the openings 58 through the flange. Then the studs 51 of each mixing bar 32 are extended through pairs of the aligned openings 58 and 59. Nuts 60 are threaded on the ends of the studs 51 to complete the attachment.

The openings 58 and 59 are positioned so that the mixing bars are at an angle, such as 45°, relative to the axis of the unit. Their inner ends 61 are adjacent the outer edge 45 of the pad 30 and their outer ends 62 are adjacent the lip 48 at the rim of the bowl. The mixing bars 32 are inclined forwardly in the direction of rotation of the bowl 10, so that their outer ends 63 are rotationally ahead of the inner ends 61. There is a gap between adjacent mixing bars 32, which are spaced apart rotationally of the bowl.

This construction means that the components of the bowl assembly are very easily assembled and disassembled. There is no permanent bonding of the major components and only removable fasteners are employed. The mixing bars 32 perform a function of holding the rim in place as well as the mixing action described below. The inner end 63 of the rim 31, in turn, engages the peripheral edge 45 of the pad 30 to hold the periphery of the pad in place within the shell 29. This simplifies the retention of the peripheral part of the pad, facilitating the installation and removal as well as providing a secure attachment.

Figure 6:
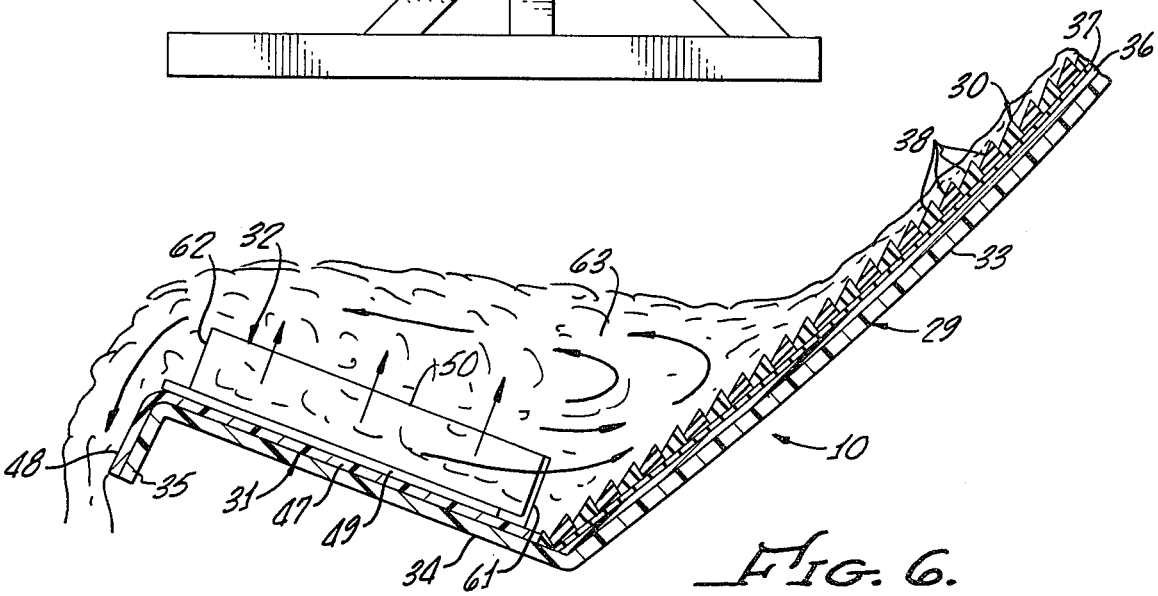
FIG. 6 is an enlarged fragmentary transverse sectional view showing the action of the mixing and classifying bars during the operation of the separator.
Figure 3:
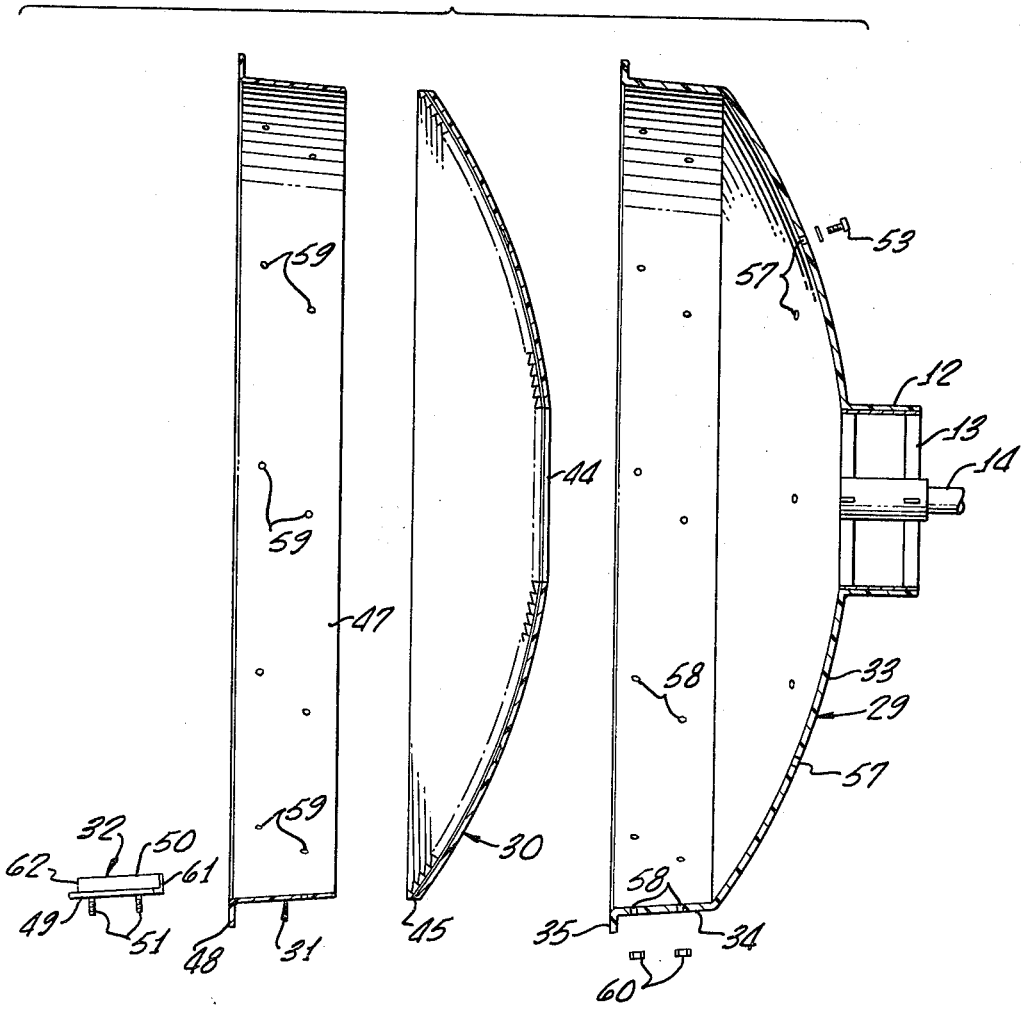
FIG. 3 is an exploded transverse sectional view of the components making up the bowl assembly of the separator.
Figure 5:
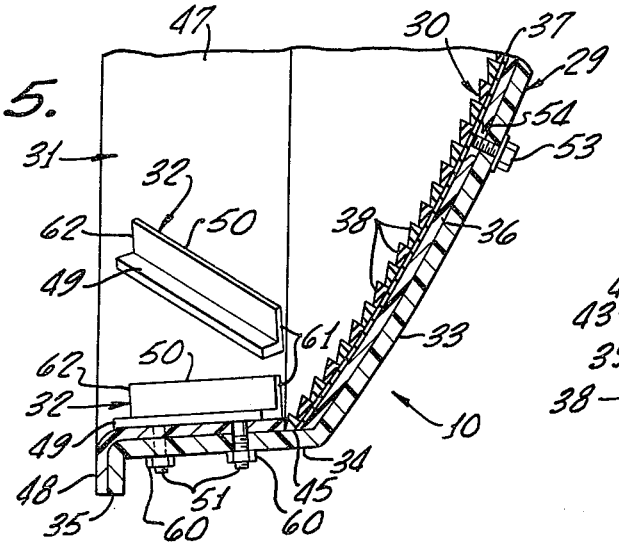
FIG. 5 is an enlarged fragmentary transverse sectional view of the outer portion of the bowl assembly, illustrating the mixing bars and their attachment to the container.

In use of the ore separator, the mixing bars 32 provide several effects which significantly enhance the efficiency of separating the heavier valuables from the gangue. By agitating the slurry of water and ore 64 that accumulates along the periphery of the bowl (see FIG. 6), they provide a mixing action which allows the heavier particles to sink to the bottom. The lighter material then can flow outwardly over the rim of the bowl as the valuables can move upwardly to the discharge opening 11. By being inclined forwardly along the periphery of the bowl, the mixing bars 32 tend to move the material at that zone upwardly along the face of the wheel. This permits the heavier particles to enter the grooves and begin their movement toward the discharge opening 11. Also, the mixing bars create a vertical pumping action of the water and solid material at the periphery of the bowl to produce a classification. When the slurry moves upwardly from this effect of the mixing bars, the heavier materials tend to stay at rest and become separated from the lighter materials. During movement of the slurry downwardly, the heavier materials tend to sink faster than the lighter materials, again resulting in a classification of the ore. A sweeping action also is produced by the mixing bars 32, causing a current in the slurry. This moves the material toward the pad 30 at the bottom, then up the face of the pad, then along the surface of the slurry and over the edge giving an additional washing action to remove the light gangue.

The foregoing detailed description is to be clearly understood as given by way of illustration and example only, the spirit and scope of this invention being limited solely by the appended claims.

I claim:

1. An ore separating device comprising a shallow container having a first concave portion with an opening at its center and a peripheral flange portion projecting from the outer edge of said first portion, means for positioning said container with its axis at an angle to the horizontal, means for rotating said container about its axis in a predetermined direction, a liner for said first portion, said liner defining spiral outwardly facing ridges on one side thereof, removable fastener means engaging said liner and said first portion for holding said liner in said first portion, an annular rim member complementarily overlying the surface of said second portion adjacent the periphery of said liner, said annular rim member engaging the peripheral edge of said liner for retaining said peripheral edge of said liner in said first portion, and a plurality of spaced vanes on said peripheral flange portion for causing agitation of ore in said container upon rotation of said container about its axis in said predetermined direction.

2. A device as recited in claim 1 in which said container is made of fiberglass.

3. A device as recited in claim 1 in which said annular rim member is made of fiberglass.

4. A device as recited in claim 1 in which each of said vanes has a first end adjacent said first portion and a second end adjacent the outer edge of said peripheral flange portion, said vanes being inclined forwardly so that said second ends are angularly ahead of said first ends with respect to said predetermined direction.

5. A device as recited in claim 4 in which said annular rim member complementarily overlies substantially the entire surface of said peripheral flange portion, said vanes being positioned on said annular rim member.

6. A device as recited in claim 5 in which each of said vanes includes fastener means for removably holding said vanes to said peripheral flange portion and for causing said vanes to retain said annular rim member in said peripheral flange portion.

7. A device as recited in claim 5 in which said fastener means of said vanes comprises threaded stud means extending outwardly through said annular rim member and said peripheral flange portion, and nut means on the exterior of said peripheral flange portion meshing with said stud means.

8. A device as recited in claim 4 in which said vanes are L-shaped members having one leg engaging said rim and the other leg projecting outwardly from said rim substantially at right angles thereto.

9. A device as recited in claim 8 in which said fastener means for removably holding said vanes to said peripheral flange portion includes a pair of threaded studs projecting outwardly from said first leg of each of said L-shaped members, and through said rim and said peripheral flange portion, and a nut on the exterior of said peripheral flange portion engaging each of said studs.

10. A device as recited in claim 1 in which said fastener means engaging said liner includes a plurality of nuts within said liner and having a threaded opening facing toward said first portion of said container, said first portion of said container having openings aligned with said threaded openings of said nuts, and screws extending through said first portion of said container and meshing with the threads in said threaded openings.

11. A device as recited in claim 10 in which said liner includes a first sheet member engaging said first portion of said container, and a second sheet member overlying said first sheet member, said nuts being received in said first sheet member and having heads countersunk below the surface of said first sheet member, thereby avoiding interference with said second sheet member.

12. A device as recited in claim 11 in which said first sheet member is thicker than said second sheet member.

13. A device as recited in claim 11 in which said sheet member is made of fiberglass.

14. A device as recited in claim 1 in which each of said vanes has a first end adjacent said first portion and a second end adjacent the outer edge of said peripheral flange portion, said vanes being inclined forwardly so that said second ends are angularly ahead of said first ends with respect to said predetermined direction.

15. For use in an ore separating device comprising a shallow container having a first concave portion with an opening at its center and a peripheral flange portion projecting from the outer edge of said first portion, means for positioning said container with its axis at an angle to the horizontal, means for rotating said container about its axis in a predetermined direction, the improvement comprising:

a liner for said first portion, said liner defining spiral outwardly facing ridges on one side thereof, the liner adapted to receive removable fastener means engaging said liner and said first portion for holding said liner in said first portion, an annular rim member for complementarily overlying the surface of said second portion adjcacent the periphery of said liner, said annular rim member adapted to engage the peripheral edge of said liner for retaining said peripheral edge of said liner in said first portion, and a plurality of spaced vanes on said peripheral flange portion for causing agitation and classification of ore in said container upon rotation of said container about its axis in said predetermined direction, whereby, said liner is easily and quickly attachable to and detachable from said first concave portion so that the ore separating device can be adapted to different ores or so that the liner if worn can be readily replaced.

16. An ore separating device comprising a shallow container having a first portion with an opening at its center and a peripheral flange portion projecting from the outer edge of said first portion, means for positioning said container with its axis at an angle to the horizontal, means for rotating said container about its axis in a predetermined direction, a liner for said first portion, said liner defining spiral outwardly facing ridges on one side thereof, and an annular rim member complementarily overlying the surface of said second portion adjacent the periphery of said liner, said annular rim member engaging the peripheral edge of said liner for retaining said peripheral edge of said liner in said first portion.

17. A device as recited in claim 16 in which a plurality of spaced vanes are provided for causing agitation of ore in said container upon rotation of said container about its axis in said predetermined direction, and in which means are provided to removably secure said vanes, liner and flange portion to each other.

* * * * *